US012179315B2

(12) United States Patent
Eckel et al.

(10) Patent No.: US 12,179,315 B2
(45) Date of Patent: Dec. 31, 2024

(54) METHOD OF MAKING A COATED ABRASIVE ARTICLE

(71) Applicant: 3M INNOVATIVE PROPERTIES COMPANY, St. Paul, MN (US)

(72) Inventors: Joseph B. Eckel, Vadnais Heights, MN (US); Aaron K. Nienaber, Maplewood, MN (US); Ronald D. Jesme, Plymouth, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1102 days.

(21) Appl. No.: 17/049,507

(22) PCT Filed: Apr. 16, 2019

(86) PCT No.: PCT/IB2019/053147
§ 371 (c)(1),
(2) Date: Oct. 21, 2020

(87) PCT Pub. No.: WO2019/207417
PCT Pub. Date: Oct. 31, 2019

(65) Prior Publication Data

US 2021/0046612 A1 Feb. 18, 2021

Related U.S. Application Data

(60) Provisional application No. 62/661,789, filed on Apr. 24, 2018.

(51) Int. Cl.
*B24D 11/00* (2006.01)
*B24D 3/28* (2006.01)
(Continued)

(52) U.S. Cl.
CPC ..... *B24D 11/005* (2013.01); *B24D 3/28* (2013.01); *B24D 11/02* (2013.01); *B24D 18/0072* (2013.01)

(58) Field of Classification Search
CPC ..... B24D 18/0072; B24D 11/02; B24D 3/28; B24D 11/005
See application file for complete search history.

(56) References Cited

U.S. PATENT DOCUMENTS 2,033,991 A 3/1936 Melton
2,857,879 A 10/1958 Johnson
(Continued)

FOREIGN PATENT DOCUMENTS

CN 1352588 6/2002
CN 1812886 8/2006
(Continued)

OTHER PUBLICATIONS

Barbee, "Microstructure of Amorphous 304 Stainless steel-carbon alloys synthesized by megnetron sputter deposition", Thin Solid Films, 1979, vol. 63, pp. 143-150.
(Continued)

*Primary Examiner* — Pegah Parvini
(74) *Attorney, Agent, or Firm* — Kathleen B. Gross; Bradford B. Wright

(57) ABSTRACT

A method of applying magnetizable particles onto an adherent web includes several steps. Step a) provides a magnetizable particle coating apparatus comprising a downward sloping dispensing surface at least partially disposed within an applied magnetic field. Step b) disposes an adherent web between upper and lower magnetic members and beneath the downward sloping dispensing surface, wherein the web comprises a backing having a curable binder precursor layer disposed on a major surface thereof. Step c) disposes magnetizable particles onto at least a portion of the downward sloping dispensing surface within the applied magnetic field, and subsequently disposed onto the curable binder precursor layer while the adherent web is advanced from an upweb position to a downweb position. Step d) at least partially
(Continued)

cures the curable binder precursor layer to fix the orientations of the magnetizable particles.

20 Claims, 5 Drawing Sheets

(51) Int. Cl.
*B24D 11/02* (2006.01)
*B24D 18/00* (2006.01)

(56) References Cited

U.S. PATENT DOCUMENTS

| | | | | |
|---|---|---|---|---|
| 3,041,156 | A | 6/1962 | Rowse | |
| 4,314,827 | A | 2/1982 | Leitheiser | |
| 1,910,444 | A | 5/1983 | Nicholson | |
| 4,518,397 | A | 5/1985 | Leitheiser | |
| 4,612,242 | A | 9/1986 | Vesley | |
| 4,623,364 | A | 11/1986 | Cottringer | |
| 4,652,275 | A | 3/1987 | Bloecher | |
| 4,734,104 | A | 3/1988 | Broberg | |
| 4,737,163 | A | 4/1988 | Larkey | |
| 4,744,802 | A | 5/1988 | Schwabel | |
| 4,770,671 | A | 9/1988 | Monroe | |
| 4,799,939 | A | 1/1989 | Bloecher | |
| 4,881,951 | A | 11/1989 | Wood | |
| 4,927,431 | A | 5/1990 | Buchanan | |
| 4,997,461 | A | 3/1991 | Markhoff-Matheny | |
| 5,009,675 | A | 4/1991 | Kunz | |
| 5,011,508 | A | 4/1991 | Wald | |
| 5,042,991 | A | 8/1991 | Kunz | |
| 5,078,753 | A | 1/1992 | Broberg | |
| 5,085,671 | A | 2/1992 | Martin | |
| 5,090,968 | A | 2/1992 | Pellow | |
| 5,108,463 | A | 4/1992 | Buchanan | |
| 5,137,542 | A | 8/1992 | Buchanan | |
| 5,139,978 | A | 8/1992 | Wood | |
| 5,152,917 | A | 10/1992 | Pieper | |
| 5,201,916 | A | 4/1993 | Berg | |
| 5,203,884 | A | 4/1993 | Buchanan | |
| 5,213,590 | A | 5/1993 | Neff | |
| 5,213,591 | A | 5/1993 | Celikkaya | |
| 5,227,104 | A | 7/1993 | Bauer | |
| 5,328,716 | A | 7/1994 | Buchanan | |
| 5,352,254 | A | 10/1994 | Celikkaya | |
| 5,366,523 | A | 10/1994 | Rowenhorst | |
| 5,417,726 | A | 5/1995 | Stout | |
| 5,435,816 | A | 7/1995 | Spurgeon | |
| 5,498,269 | A | 3/1996 | Larmie | |
| 5,505,747 | A | 4/1996 | Chesley | |
| 5,560,753 | A | 10/1996 | Buchanan | |
| 5,565,011 | A | 10/1996 | Follett | |
| 5,573,619 | A | 11/1996 | Benedict | |
| 5,578,098 | A * | 11/1996 | Gagliardi | B24D 3/344 428/327 |
| RE35,570 | E | 7/1997 | Rowenhorst | |
| 5,672,097 | A | 9/1997 | Hoopman | |
| 5,700,302 | A | 12/1997 | Stoetzel | |
| 5,946,991 | A | 9/1999 | Hoopman | |
| 5,975,987 | A | 11/1999 | Hoopman | |
| 5,984,988 | A | 11/1999 | Berg | |
| 6,129,540 | A | 10/2000 | Hoopman | |
| 6,364,747 | B1 * | 4/2002 | Gagliardi | B24D 3/34 451/526 |
| 6,843,815 | B1 | 1/2005 | Thurber | |
| 7,727,931 | B2 | 6/2010 | Brey | |
| 8,034,137 | B2 | 10/2011 | Erickson | |
| 8,142,531 | B2 | 3/2012 | Adefris | |
| 8,142,532 | B2 | 3/2012 | Erickson | |
| 8,142,891 | B2 | 3/2012 | Culler | |
| 8,551,577 | B2 | 10/2013 | Moren | |
| 8,698,394 | B2 | 4/2014 | McCutcheon | |
| 2009/0165394 | A1 | 7/2009 | Culler | |
| 2009/0169816 | A1 | 7/2009 | Erickson | |
| 2012/0227333 | A1 | 9/2012 | Adefris | |
| 2013/0040537 | A1 | 2/2013 | Schwabel | |
| 2013/0125477 | A1 | 5/2013 | Adefris | |
| 2013/0344786 | A1 | 12/2013 | Keipert | |
| 2014/0290147 | A1 | 10/2014 | Seth | |
| 2015/0267097 | A1 * | 9/2015 | Rosenflanz | C09K 3/1409 451/28 |
| 2016/0144480 | A1 | 5/2016 | Eugster | |
| 2016/0221153 | A1 | 8/2016 | Rizzo, Jr. | |
| 2017/0225298 | A1 | 8/2017 | Goers | |
| 2018/0029194 | A1 | 2/2018 | Keipert | |

FOREIGN PATENT DOCUMENTS

| | | |
|---|---|---|
| CN | 102575333 | 7/2012 |
| CN | 203536394 U | 4/2014 |
| CN | 104999385 | 10/2015 |
| CN | 106794570 | 5/2017 |
| DE | 643683 C | 4/1937 |
| WO | WO 2000-64588 | 11/2000 |
| WO | WO 2011-139562 | 11/2011 |
| WO | WO 2014-176108 | 10/2014 |
| WO | WO 2015-100220 | 7/2015 |
| WO | WO 2018-080703 | 5/2018 |
| WO | WO 2018-080704 | 5/2018 |
| WO | WO 2018-080705 | 5/2018 |
| WO | WO 2018-080755 | 5/2018 |
| WO | WO 2018-080756 | 5/2018 |
| WO | WO 2018-080784 | 5/2018 |
| WO | WO 2018-080799 | 5/2018 |
| WO | WO 2018-134732 | 7/2018 |
| WO | WO 2018-136268 | 7/2018 |
| WO | WO 2018-136269 | 7/2018 |
| WO | WO 2018-136271 | 7/2018 |
| WO | WO 2019-207415 | 10/2019 |
| WO | WO 2019-207416 | 10/2019 |

OTHER PUBLICATIONS

International Search Report for PCT International Application No. PCT/IB2019/053147, mailed on Jul. 29, 2019, 5 pages.

* cited by examiner

METHOD OF MAKING A COATED ABRASIVE ARTICLE

TECHNICAL FIELD

The present disclosure broadly relates to methods of making coated abrasive articles.

BACKGROUND

Coated abrasive articles are conventionally made by coating abrasive particles onto a make layer precursor disposed on a backing. The make precursor layer is then at least partially cured to form a make layer where the abrasive particles are bound to the backing by the make layer. A size layer precursor is disposed on the make layer and abrasive particles, and the size layer precursor is cured. Optionally, but commonly, a supersize layer (which may contain, grinding aids, lubricants, etc.) is disposed on the size layer. The make and size layers generally include a thermosetting resin (e.g., phenolic resin, aminoplast resin, curable acrylic resin, cyanate resin, or a combination thereof).

Orientation of the abrasive particles in coated abrasive articles generally has an influence on abrading properties. In the instance that the abrasive particles are precisely-shaped (e.g., into triangular platelets or conical particles), this effect of orientation can be especially important.

Various methods of positioning shaped abrasive particles are known.

For example, U.S. Pat. Appl. Publ. No. 2013/0344786 A1 (Keipert) discloses a coated abrasive article having a plurality of formed ceramic abrasive particles each having a surface feature. The plurality of formed ceramic abrasive particles attached to a flexible backing by a make coat comprising a resinous adhesive forming an abrasive layer. The surface feature having a specified z-direction rotational orientation, and the specified z-direction rotational orientation occurs more frequently in the abrasive layer than would occur by a random z-direction rotational orientation of the surface feature.

Similarly, WO 2015/100220 A1 (Culler et al.) discloses a coated abrasive article maker apparatus including a first web path guiding a production tool such that it wraps a portion of the outer circumference of an abrasive particle transfer roll; a second web path for a resin coated backing guiding the resin coated backing such that it wraps a portion of the outer circumference of the abrasive particle transfer roll with the resin layer positioned facing the dispensing surface of the production tool this is positioned between the resin coated backing and the outer circumference of the abrasive particle transfer roll; and wherein abrasive particles are transferred from cavities in the production tool to the resin coated backing as the resin coated backing and the production tool traverse around the abrasive particle transfer roll.

U.S. Pat. Appl. Publ. 2016/0221153 A1 (Rizzo, Jr.) describes that abrasive grains may be alignable in response to being exposed to an electrical current and/or a magnetic field. The abrasive grains may be aligned of a film that is processed into a grinding wheel.

SUMMARY

The present disclosure provides alternative practical methods for making coated abrasive articles the rely on an applied magnetic field during application of magnetizable abrasive particles to the make layer precursor, thereby influencing their final orientation in the coated abrasive article.

Coated abrasive articles prepared according to the present disclosure do not require specialized tools with cavities therein to achieve preferential orientation of the magnetizable abrasive particles in the resultant coated abrasive article. Moreover, for smaller grades of abrasive particles, methods according to the present disclosure may be conveniently practiced in contrast to methods that rely on a tool with cavities, wherein fouling of the tool with the make layer precursor poses a significant problem during use. Accordingly, in one aspect, the present disclosure provides a method of applying magnetizable particles onto an adherent web, the method comprising:

a) providing a magnetizable particle coating apparatus comprising a downward sloping dispensing surface at least partially disposed within an applied magnetic field;

b) disposing the adherent web between upper and lower magnetic members and beneath the downward sloping dispensing surface, wherein the web comprises a backing having a curable binder precursor layer disposed on a major surface thereof; and c) disposing magnetizable particles onto at least a portion of the downward sloping dispensing surface within the applied magnetic field, and subsequently disposing the magnetizable particles onto the curable binder precursor layer while the adherent web is advanced from an upweb position to a downweb position; and d) at least partially curing the curable binder precursor layer to fix the orientations of the magnetizable particles.

As used herein:

The term "crushed abrasive particle" refers to an abrasive particle that is formed through a mechanical fracturing process, and specifically excludes abrasive particles that are evidently formed into shaped abrasive particles by a molding operation and then fractured. The material fractured to produce the crushed abrasive particle may be in the form of bulk abrasive or an abrasive precursor. It may also be in the form of an extruded rod or other profile or an extruded or otherwise formed sheet of abrasive or abrasive precursor. Mechanical fracturing includes for example roll or jaw crushing as well as fracture by explosive comminution.

The term "downweb" refers to the direction of web travel while "upweb" refers to its opposite direction.

The term "ferrimagnetic" refers to materials that exhibit ferrimagnetism. Ferrimagnetisin is a type of permanent magnetism that occurs in solids in which the magnetic fields associated with individual atoms spontaneously align themselves, some parallel, or in the same direction (as in ferromagnetism), and others generally antiparallel, or paired off in opposite directions (as in antiferromagnetism). The magnetic behavior of single crystals of ferrimagnetic materials may be attributed to the parallel alignment; the diluting effect of those atoms in the antiparallel arrangement keeps the magnetic strength of these materials generally less than that of purely ferromagnetic solids such as metallic iron. Ferrimagnetism occurs chiefly in magnetic oxides known as ferrites. The spontaneous alignment that produces ferrimagnetism is entirely disrupted above a temperature called the Curie point, characteristic of each ferrimagnetic material. When the temperature of the material is brought below the Curie point, ferrimagnetism revives.

The term "ferromagnetic" refers to materials that exhibit ferromagnetism. Ferromagnetism is a physical phenomenon in which certain electrically uncharged materials strongly attract others. In contrast to other substances, ferromagnetic materials are magnetized easily, and in strong magnetic fields the magnetization approaches a definite limit called saturation. When a field is applied and then removed, the magnetization does not return to its original value. This phenomenon is referred to as hysteresis. When heated to a certain temperature called the Curie point, which is generally different for each substance, ferromagnetic materials lose their characteristic properties and cease to be magnetic; however, they become ferromagnetic again on cooling.

The term "magnet" can include a ferromagnetic material that responds to a magnetic field and acts as a magnet. A "magnet" can be any material that exerts a magnetic field in either a permanent, semi-permanent, or temporary state. The term "magnet" can be one individual magnet or an assembly of magnets that would act like a single magnet. The term "magnet" can include permanent magnets and electromagnets.

The terms "magnetic" and "magnetized" mean being ferromagnetic or ferrimagnetic at 20° C., or capable of being made so, unless otherwise specified. Preferably, magnetizable layers according to the present disclosure either have, or can be made to have by exposure to an applied magnetic field, a magnetic moment of at least 0.001 electromagnetic units (emu), more preferably at least 0.005 emu, more preferably 0.01 emu, up to an including 0.1 emu, although this is not a requirement.

The term "applied magnetic field" refers to a magnetic field that is deliberately created and excludes those generated by an natural (e.g., astronomical) body or bodies (e.g., Earth or the sun) or are the accidental result of environmental electric circuits (e.g., architectural electrical wiring).

The term "magnetizable" means capable of being magnetized or already in a magnetized state.

The term "shaped abrasive particle" refers to a ceramic abrasive particle that has been intentionally shaped (e.g., extruded, die cut, molded, screen-printed) at some point during its preparation such that the resulting abrasive particle is non-randomly shaped. The term "shaped abrasive particle" as used herein excludes abrasive particles obtained by a mechanical crushing or milling operation.

The term "platey crushed abrasive particle", which refers to a crushed abrasive particle resembling a platelet and/or flake that is characterized by a thickness that is less than the width and length. For example, the thickness may be less than ½, ⅓, ¼, ⅕, ⅙, ⅐, ⅛, ⅑, or even less than 1/10 of the length and/or width. Likewise, the width may be less than ½, ⅓, ¼, ⅕, ⅙, ⅐, ⅛, ⅑, or even less than 1/10 of the length.

The term "essentially free of" means containing less than 5 percent by weight (e.g., less than 4, 3, 2, 1, 0.1, or even less than 0.01 percent by weight, or even completely free) of, based on the total weight of the object being referred to.

The terms "precisely-shaped abrasive particle" refers to an abrasive particle wherein at least a portion of the abrasive particle has a predetermined shape that is replicated from a mold cavity used to form a precursor precisely-shaped abrasive particle that is sintered to form the precisely-shaped abrasive particle. A precisely-shaped abrasive particle will generally have a predetermined geometric shape that substantially replicates the mold cavity that was used to form the abrasive particle.

The term "length" refers to the longest dimension of an object.

The term "width" refers to the longest dimension of an object that is perpendicular to its length.

The term "thickness" refers to the longest dimension of an object that is perpendicular to both of its length and width.

The term "aspect ratio" refers to the ratio length/thickness of an object.

The term "substantially" means within 35 percent (preferably within 30 percent, more preferably within 25 percent, more preferably within 20 percent, more preferably within 10 percent, and more preferably within 5 percent) of the attribute being referred to.

The suffix "(s)" indicates that the modified word can be singular or plural.

Features and advantages of the present disclosure will be further understood upon consideration of the detailed description as well as the appended claims.

Figure 1:
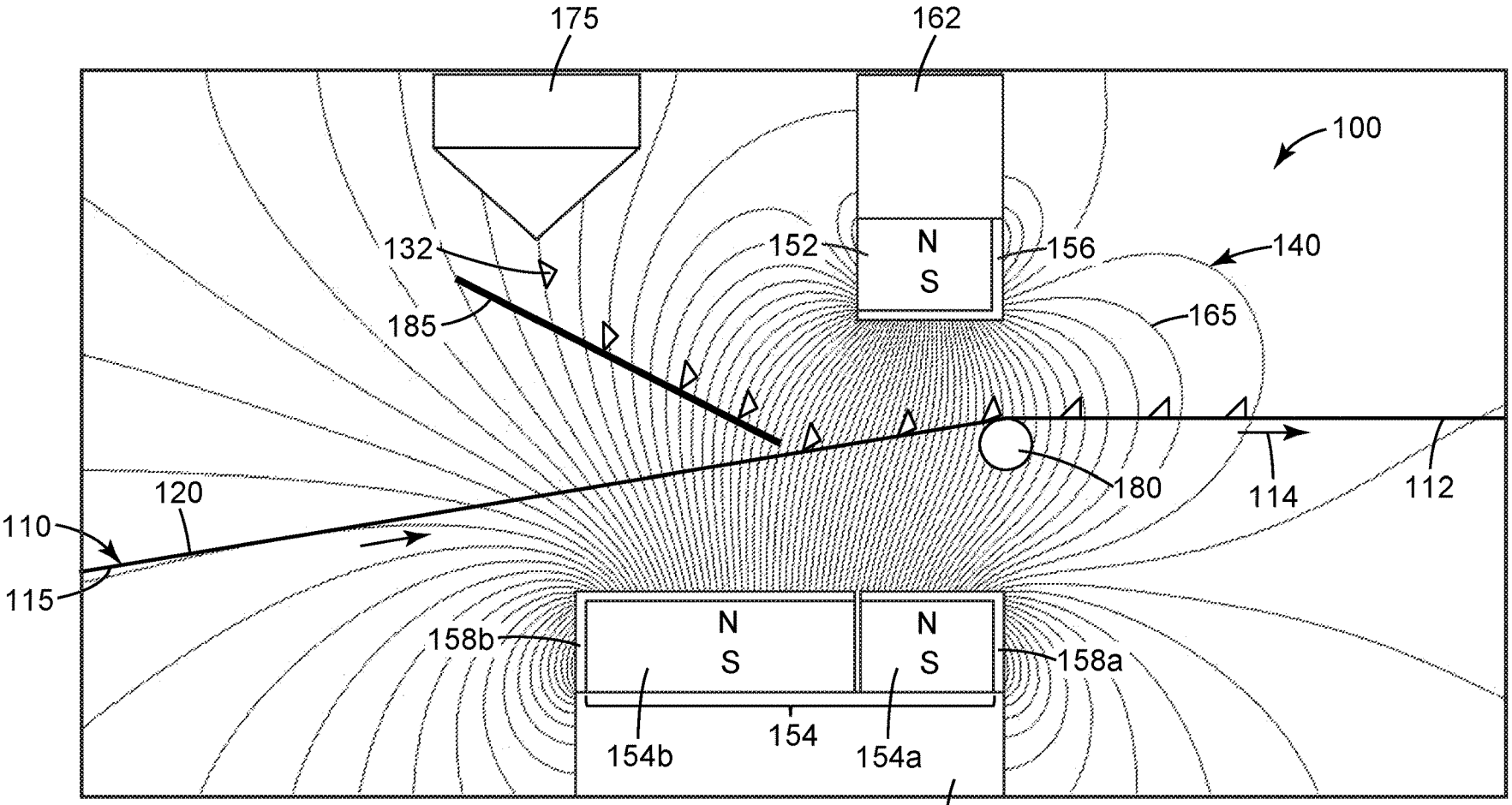
FIG. 1 is a schematic side view of an exemplary coating process 100 according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

FIG. 1 depicts an exemplary process 100 according to the present disclosure. Referring now to FIG. 1, web 110 comprising a backing 115 having a make layer precursor 120 disposed (see FIG. 3) thereon moves along web path 112 in a downweb direction 114 (i.e., machine direction). Web 110 has a crossweb direction (not shown) that is perpendicular to downweb direction 114. Make layer precursor 120 comprises a first curable binder precursor (not shown). Magnetizable particles 132 are dropped through a portion of an applied magnetic field 140 onto make layer precursor 120. At least some of magnetizable particles 132 are abrasive particles. Magnetizable particles 132 are predominantly deposited onto web 110 after travelling down downward sloping dispensing surface 185, which is fed from hopper 175. While travelling down downward sloping dispensing surface 185 the longest side of the magnetizable abrasive particles tends to align with applied magnetic field 140. Various web handling components 180 (e.g., rollers, conveyor belts, feed rolls, and take up rolls) handle web 110.

Throughout the process, at least until transfer of the magnetizable abrasive particles to the make precursor layer, the magnetizable particles are continuously oriented by the applied magnetic field with their longest axis being aligned substantially parallel (or antiparallel) with the magnetic field lines 165. Once transferred, the applied magnetic field may continue to exert an orienting influence on the magnetizable abrasive particles, although this is not requirement.

In general, applied magnetic fields used in practice of the present disclosure have a field strength in the region of the magnetizable particles being affected (e.g., attracted and/or oriented) of at least about 10 gauss (1 mT), preferably at least about 100 gauss (10 mT), and more preferably at least about 1000 gauss (0.1 T), although this is not a requirement.

The applied magnetic field can be provided by one or more permanent magnets and/or electromagnet(s), or a combination of magnets and ferromagnetic members, for example. Preferred permanent magnets include rare-earth magnets comprising magnetizable materials are described hereinabove. The applied magnetic field can be static or variable (e.g., oscillating). The upper and/or lower magnetic members (152, 154), each having north (N) and south (S) poles, may be monolithic or they may be composed of multiple component magnets (154*a*, 154*b*) and/or magnetizable bodies, for example. If comprised of multiple magnets, the multiple magnets in a given magnetic member should preferably be contiguous and/or co-aligned (e.g., at least substantially parallel) with respect to their magnetic field lines where the components magnets closest approach each other. Stainless steel retainers 156, 158*a*, and 158*b* retain the magnets in position. While stainless steel 304 or an equivalent is preferred due to its non-magnetic character, magnetizable materials may also be used. Mild steel mounts 162, 164 support the stainless steel retainers 156, 158*a* and 158*b*, respectively. While steel mounts are shown in FIG. 1 the mounts may be made of any dimensionally stable material(s) whether magnetizable or not.

The downward sloping dispensing surface may be inclined at any suitable angle, provided that the magnetizable particles can travel down the surface and be dispensed onto the web. Typical angle may be in a range of from 15 to 60 degrees, although other angles may also be used. In some instances, it may be desirable to vibrate the downward sloping dispensing surface to facilitate particle movement, for example.

The downward sloping dispensing surface may be constructed of any dimensionally stable material, preferably non-magnetizable. Examples include: metals such as aluminum; wood; and plastic.

Figure 2A:
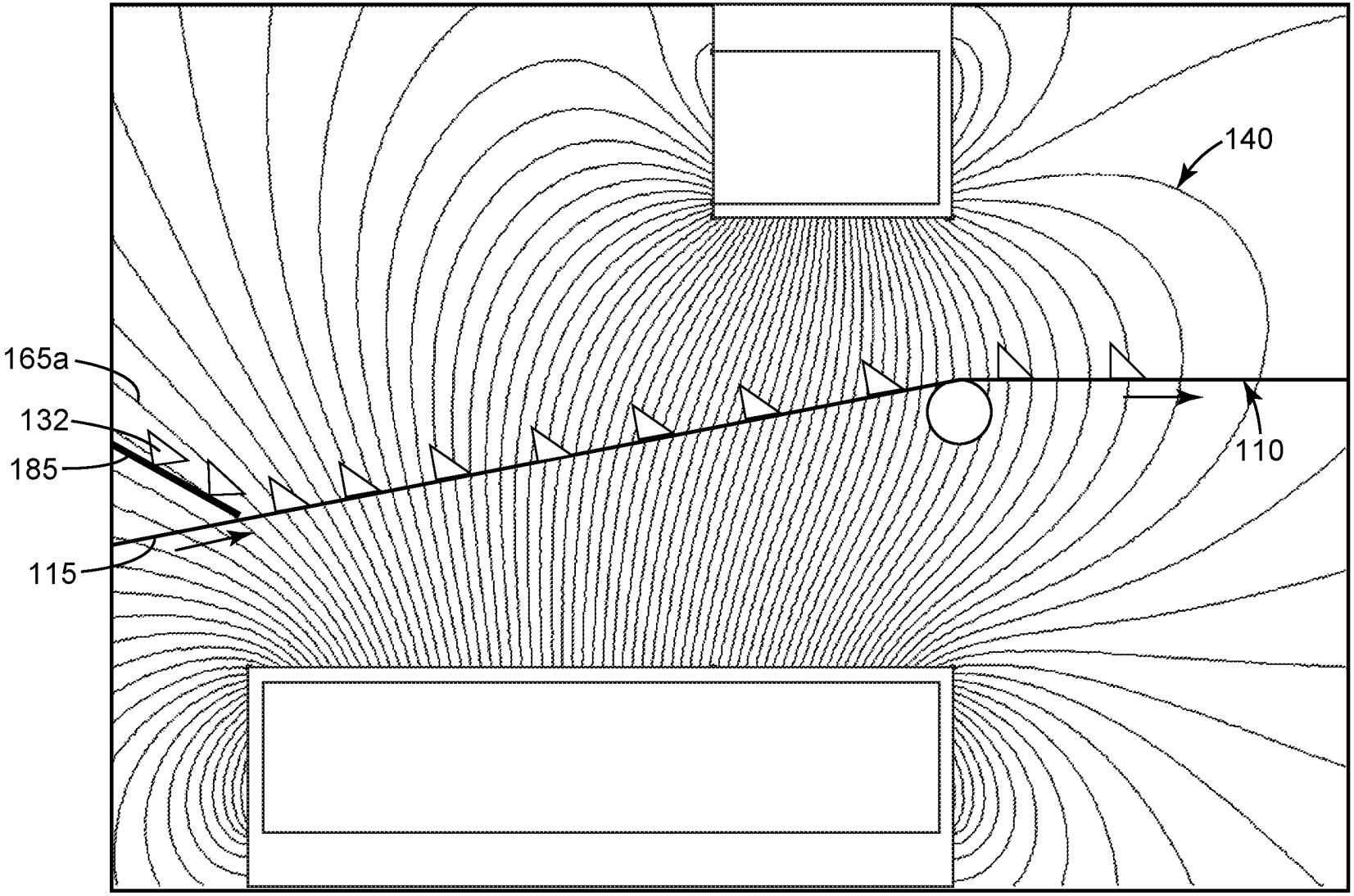
FIGS. 2A-2C are exemplary configurations of particle coating apparatus 100 in which the downward sloping dispensing surface is situated at various positions within the applied magnetic field 140 in FIG. 1.
Figure 2B:
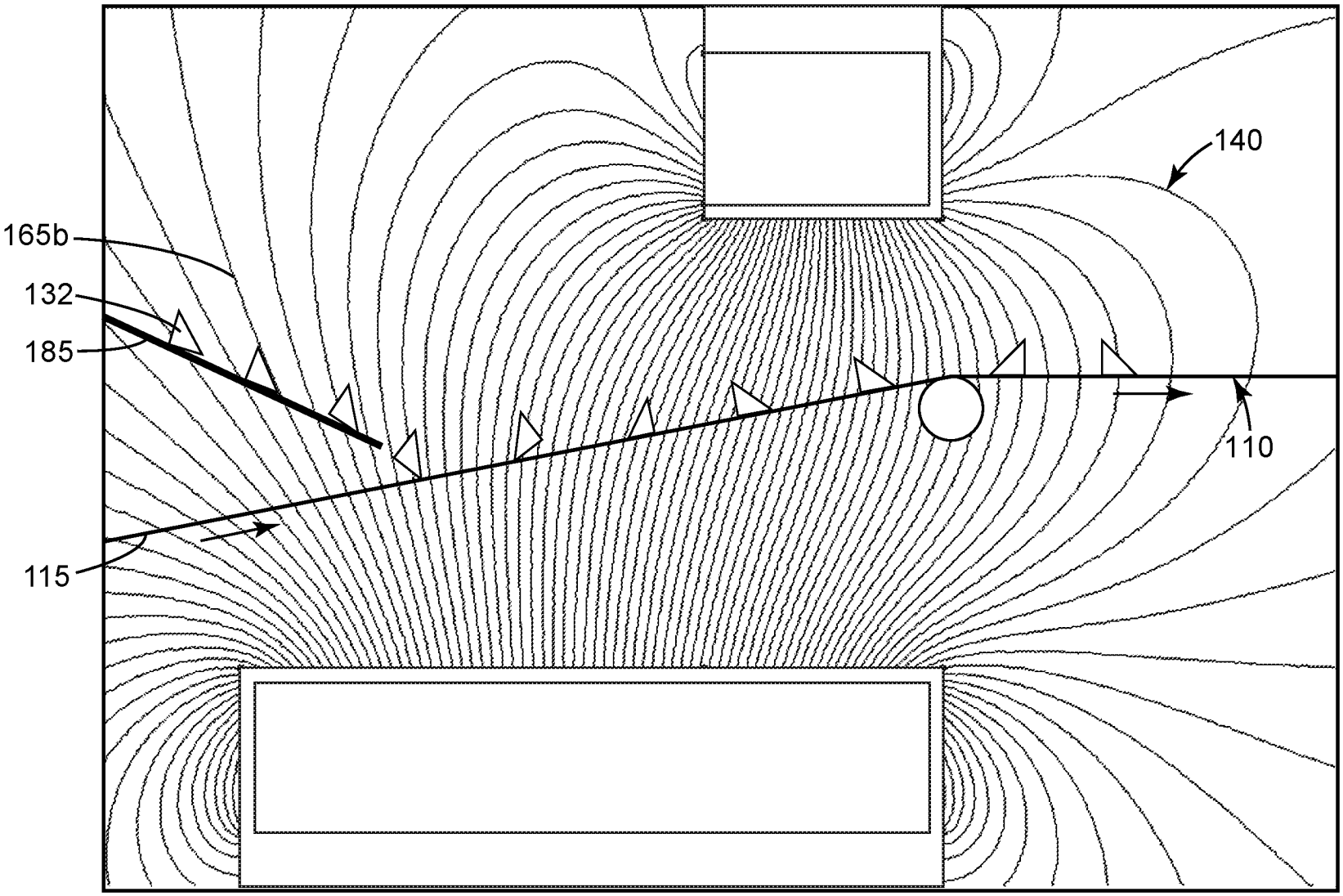
Figure 2C:
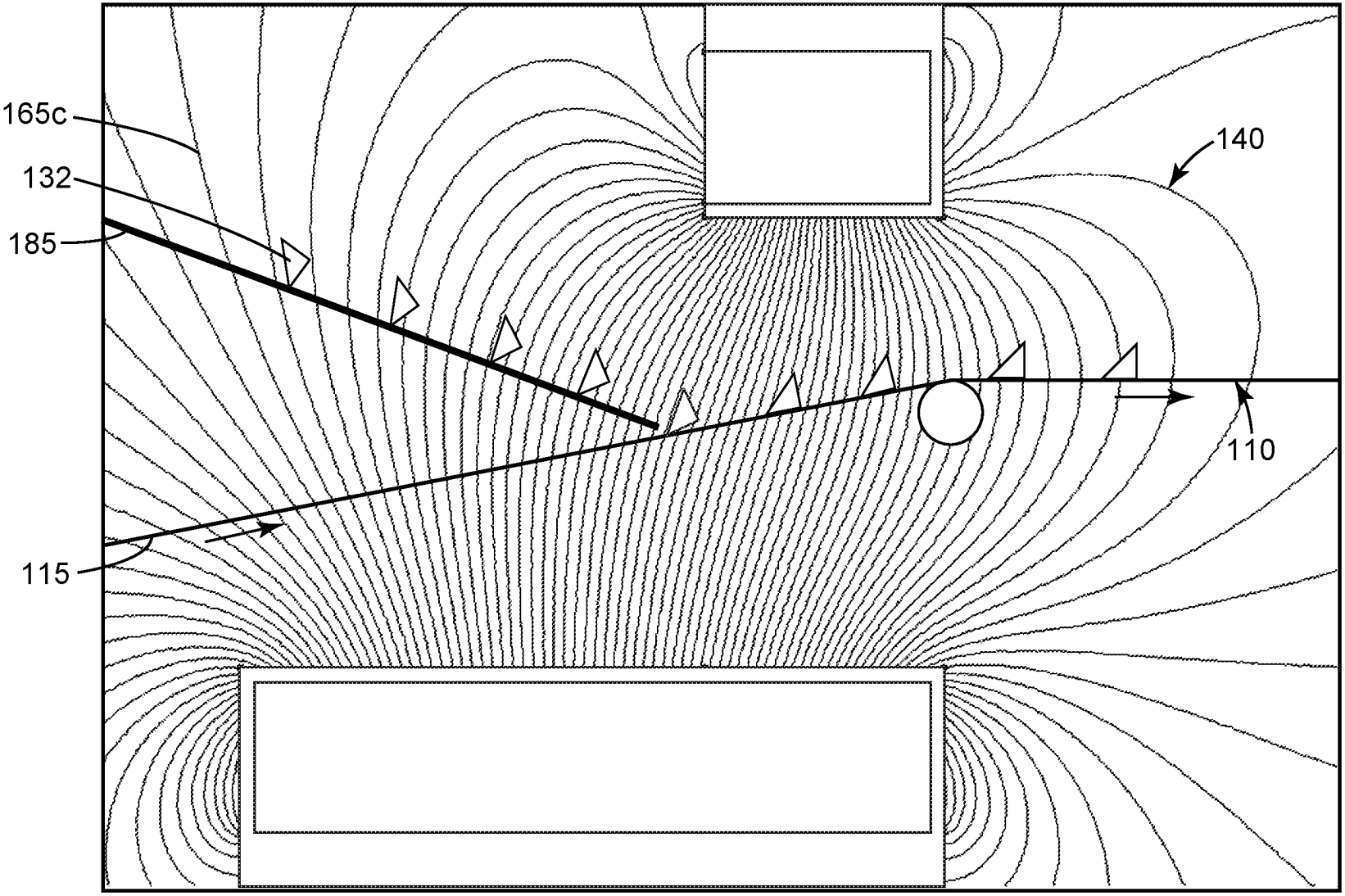

FIGS. 2A-2C depict the general process in FIG. 1 showing the alignment of the magnetizable particles 132 at the location of transfer from downward sloping dispensing surface 185 onto web 110 depending on the position of downward sloping dispensing surface 185 in the applied magnetic field 140.

For example, in the configuration shown in FIG. 2A, magnetizable shaped abrasive particles 132 are dispensed onto web 110 where magnetic field lines 165 form downweb angle $\alpha$ with the web 110 of less than 90° such that when transferred to the web they attain an orientation with their long edges sloping upward from right to left. As shown, magnetizable shaped abrasive particles 132 slide down downward sloping dispensing surface 185 and begin to orient with their longest edge aligning with magnetic field lines 165. As magnetizable shaped abrasive particles 132 contact make layer precursor 120 of web 110, they are leaning downweb. Gravity and/or the lower magnetic member cause the magnetic shaped abrasive particles to sit down onto make layer precursor 120, and after curing they are subsequently adhered to backing 115. The majority of magnetizable shaped abrasive particles 132 are adhered with a nominal rake angle (i.e., the angle between the backing and the leading edge of a magnetizable shaped abrasive particle in an indicated direction (e.g., upweb or downweb) of about 90° in the upweb direction. Referring now to the configuration shown in FIG. 2B, magnetizable shaped abrasive particles 132 align such that when transferred to web 110 they attain an orientation with their longest edge sloping upward from either right to left or left to right. As magnetizable shaped abrasive particles 132 slide down downward sloping dispensing surface 185 and begin to orient with their longest edge aligning with magnetic field lines 165. Magnetizable shaped abrasive particles 132 are dispensed onto web 110 where magnetic field lines 165 are approximately perpendicular to web 110. Magnetizable shaped abrasive particles 132 are disposed onto web 110 with their longest edges approximately perpendicular to the backing. This allows the particles to rotate about their longest edge. The lower magnetic member and/or gravity causes magnetizable shaped abrasive particles 132 to sit down onto make layer precursor 120, and after curing they are subsequently adhered to backing 115. Roughly equal percentages of the magnetizable shaped abrasive particles have a nominal 90° rake angle facing the downweb direction as facing the upweb direction.

Lastly, in the configuration shown in FIG. 2C, magnetizable shaped abrasive particles 132 align such that when transferred to the web they attain an orientation with their long edges sloping upward from left to right. As magnetizable shaped abrasive particles 132 slide down downward sloping dispensing surface 185, they begin to orient with their longest edge aligning with magnetic field lines 165. Magnetizable shaped abrasive particles 132 are dispensed on backing where magnetic field lines 165 downweb angle $\beta$ with web 100 of greater than 90°. As the particles contact the web, they are leaning forward in the downweb direction. The lower magnetic member and/or gravity causes magnetizable shaped abrasive particles 132 to sit down onto make layer precursor 120, and after curing they are subsequently adhered to backing 115. A majority of magnetizable shaped abrasive particles 132 become adhered to web 110 with a rake angle of about 0° in the downweb direction.

Once the magnetizable particles are coated on to the curable binder precursor it is at least partially cured at a first curing station (not shown), so as to firmly retain the magnetizable particles in position. In some embodiments, additional magnetizable and/or non-magnetizable particles (e.g., filler abrasive particle and/or grinding aid particles) can be applied to the make layer precursor prior to curing.

In the case of a coated abrasive article, the curable binder precursor comprises a make layer precursor, and the magnetizable particles comprise magnetizable abrasive particles. A size layer precursor is then typically applied over the at least partially cured make layer precursor and the magnetizable abrasive particles, although this is not a requirement. If present, the size layer precursor is then at least partially cured at a second curing station, optionally with further curing of the at least partially cured make layer precursor. In some embodiments, a supersize layer is disposed on the at least partially cured size layer precursor.

Lastly, the finished web is converted into useful forms of coated abrasive articles such as, for example, discs, sheets, and/or belts.

Figure 3:
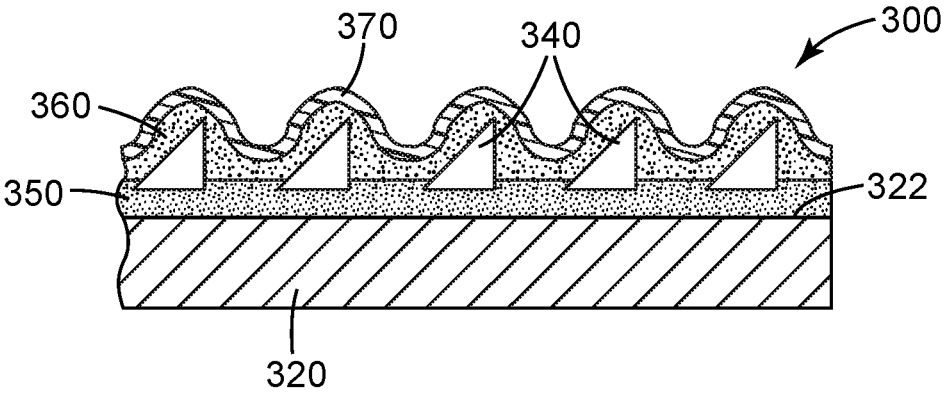
FIG. 3 is a schematic side view of a coated abrasive article 300 prepared according to the method of the present disclosure.

FIG. 3 shows an exemplary coated abrasive article 300 prepared according to the method of the present disclosure. Make layer 350 is disposed on major surface 322 of backing 320. Size layer 360 overlays make layer 350 and magnetizable particles 340 thereby securing them to backing 320. Optional supersize layer 370 overlays size layer 360.

As will be apparent to those of skill in the art, the make layer precursor, optional size layer precursor, and optional supersize layer can be coated using conventional techniques such as, for example, gravure coating, curtain coating, knife coating, spray coatings, roll-coating, reverse roll gravure coating, or bar coating.

Exemplary backings include those known in the art for making coated abrasive articles, including conventional sealed coated abrasive backings and porous non-sealed backings. Typically, the backing has two opposed major surfaces. The thickness of the backing generally ranges from about 0.02 to about 5 millimeters, desirably from about 0.05 to about 2.5 millimeters, and more desirably from about 0.1 to about 0.4 millimeter, although thicknesses outside of these ranges may also be useful.

The backing may be flexible or rigid. Desirably the backing is flexible. Exemplary backings include polymeric film (including primed films) such as polyolefin film (e.g., polypropylene including biaxially oriented polypropylene, polyester film, polyamide film, cellulose ester film), metal foil, mesh, foam (e.g., natural sponge material or polyurethane foam), cloth (e.g., cloth made from fibers or yarns comprising polyester, nylon, silk, cotton, and/or rayon), paper, vulcanized paper, vulcanized fiber, nonwoven materials, combinations thereof, and treated versions thereof. Cloth backings may be woven or stitch bonded. Desirably, the backing comprises polypropylene film.

The backing may be made of any number of various materials including those conventionally used as backings in the manufacture of coated abrasives. Examples include paper, cloth, film, polymeric foam, vulcanized fiber, woven and nonwoven materials, combinations of two or more of these materials, as well as treated versions thereof. The backing may also be a laminate of two materials (e.g., paper/film, cloth/paper, film/cloth).

The backing may be treated to include a presize (i.e., a barrier coat overlying the major surface of the backing onto which the abrasive layer is applied), a backsize (i.e., a barrier coat overlying the major surface of the backing opposite the major surface on which the abrasive layer is applied), a saturant (i.e., a barrier coat that is coated on all exposed surfaces of the backing), or a combination thereof. Useful presize, backsize, and saturant compositions include glue, phenolic resins, lattices, epoxy resins, urea-formaldehyde, urethane, melamine-formaldehyde, neoprene rubber, butyl acrylate, styrol, starch, and combinations thereof. Other optional layers known in the art may also be used (e.g., a tie layer; see, e.g., U.S. Pat. No. 5,700,302 (Stoetzel et al.)).

Backing treatments may contain additional additives such as, for example, a filler and/or an antistatic material (for example, carbon black particles, vanadium pentoxide particles). The addition of an antistatic material can reduce the tendency of the coated abrasive article to accumulate static electricity when sanding wood or wood-like materials. Additional details regarding antistatic backings and backing treatments can be found in, for example, U.S. Pat. No. 5,108,463 (Buchanan et al.); U.S. Pat. No. 5,137,542 (Buchanan et al.); U.S. Pat. No. 5,328,716 (Buchanan); and U.S. Pat. No. 5,560,753 (Buchanan et al.).

Typically, at least one major surface of the backing is smooth (for example, to serve as the first major surface). The second major surface of the backing may comprise a slip resistant or frictional coating. Examples of such coatings include an inorganic particulate (e.g., calcium carbonate or quartz) dispersed in an adhesive.

The backing may contain various additive(s). Examples of suitable additives include colorants, processing aids, reinforcing fibers, heat stabilizers, UV stabilizers, and antioxidants. Examples of useful fillers include clays, calcium carbonate, glass beads, talc, clays, mica, wood flour; and carbon black.

The backing may be a fibrous reinforced thermoplastic such as described, for example, as described, for example, in U.S. Pat. No. 5,417,726 (Stout et al.), or an endless spliceless belt, for example, as described, for example, in U.S. Pat. No. 5,573,619 (Benedict et al.). Likewise, the backing may be a polymeric substrate having hooking stems projecting therefrom such as that described, for example, in U.S. Pat. No. 5,505,747 (Chesley et al.). Similarly, the backing may be a loop fabric such as that described, for example, in U.S. Pat. No. 5,565,011 (Follett et al.)

The curable binder precursor, make layer precursor, and the size layer precursor compositions include respective curable binder precursor compositions, which may be the same or different.

Examples of curable binder precursor compositions for use in the make and/or size layer precursors include phenolic resins, urea-formaldehyde resins, acrylate resins, urethane resins, epoxy resins, aminoplast resins, and combinations thereof. The curable binder precursor compositions can also include various additives including, for example, grinding aids, plasticizers, fillers, fibers, lubricants, surfactants, wetting agents, dyes, pigments, antifoaming agents, dyes, coupling agents, plasticizers, and suspending agents.

Depending on any curable binder precursor composition selected, an appropriate curative may be added to facilitate curing. Such curatives will be readily apparent to those of skill in the art, and may be thermally activated, photochemically activated, or both, for example.

Examples of useful supersize layer compositions include metal salts of fatty acids, urea-formaldehyde, novolac phenolic resins, epoxy resins, waxes, and mineral oils.

The magnetizable particles have sufficient magnetic susceptibility that they can be influenced by the applied magnetic field. Any magnetizable particle may be used. In some preferred embodiments, the magnetizable particles have a magnetizable layer disposed on at least a portion of the outer surface of a non-magnetizable particle. For example, otherwise non-magnetic (e.g., non-magnetizable) particles can be rendered magnetizable by coating some or all of the particle surface with a magnetizable material coating.

Examples of magnetizable coatings include coatings of an adhesive binder (e.g., waterglass) and magnetizable particles such as, for example, ferromagnetic metals, and/or ferromagnetic metal oxides.

In one embodiment, the outer surfaces of abrasive particles are moistened with waterglass. As used herein, the term "waterglass" refers to an aqueous solution of alkali silicate(s) (e.g., lithium, sodium, and/or potassium silicate) and combinations thereof. Alkali silicate is the common name for compounds with the formula $(SiO_2)_n(M_2O)$ and their hydrates where n is a positive integer and M is an alkali metal (e.g., sodium or potassium). A well-known member of this series is sodium metasilicate, $Na_2SiO_3$ (i.e., n=1, M=Na), which is commercially available in anhydrous and hydrated forms (e.g., $Na_2SiO_3.5H_2O$). While water should generally be the primary liquid component, organic cosolvents (e.g., methanol, ethanol, isopropanol, glyme, diglyme, propylene glycol, and/or acetone) may also be present. Other components such as, for example, surfactant(s), thickener(s), thixotrope(s), and colorant(s), may be included in the waterglass if desired. The concentration of alkali silicate in the waterglass is not critical (as long as it is dissolved and the waterglass is liquid), but it is preferably from 25 to 70 percent by weight, more preferably 30 to 55 percent by weight. In this context, percent by weight is to be calculated based on the anhydrous form of alkali silicate(s) that is/are present in the waterglass.

Magnetizable particles included with the waterglass may comprise magnetizable material such as, for example: iron;

cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (typically about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samarium and cobalt (e.g., $SmCo_5$); MnSb; $MnOFe_2O_3$; $Y_3Fe_5O_{12}$; $CrO_2$; MnAs; ferrites such as ferrite, magnetite; zinc ferrite; nickel ferrite; cobalt ferrite, magnesium ferrite, barium ferrite, and strontium ferrite; yttrium iron garnet; and combinations of the foregoing. In some preferred embodiments, the magnetizable material comprises at least one metal selected from iron, nickel, and cobalt, an alloy of two or more such metals, or an alloy of at one such metal with at least one element selected from phosphorus and manganese. In some preferred embodiments, the magnetizable material is an alloy containing 8 to 12 weight percent (wt. %) aluminum, 15 to 26 wt. % nickel, 5 to 24 wt. % cobalt, up to 6 wt. % copper, up to 1% titanium, wherein the balance of material to add up to 100 wt. % is iron.

In some other embodiments, a magnetizable layer can be deposited on a non-magnetizable (e.g., a non-magnetizable abrasive mineral) particle body using a vapor deposition technique such as, for example, physical vapor deposition (PVD) including magnetron sputtering. PVD metallization of various metals, metal oxides and metallic alloys is disclosed in, for example, U.S. Pat. No. 4,612,242 (Vesley) and U.S. Pat. No. 7,727,931 (Brey et al.).

Examples of metallic materials that can be vapor-deposited include stainless steels, nickel, and cobalt. Exemplary useful magnetizable particles/materials can comprise: iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (typically about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, and alloys of samarium and cobalt (e.g., $SmCo_5$); MnSb; ferrites such as ferrite, magnetite; zinc ferrite; nickel ferrite; cobalt ferrite, magnesium ferrite, barium ferrite, and strontium ferrite; and combinations of the foregoing. In some embodiments, the magnetizable material comprises at least one metal selected from iron, nickel, and cobalt, an alloy of two or more such metals, or an alloy of at one such metal with at least one element selected from phosphorus and manganese. In some embodiments, the magnetizable material is an alloy containing 8 to 12 weight percent (wt. %) aluminum, 15 to 26 wt. % nickel, 5 to 24 wt. % cobalt, up to 6 wt. % copper, up to 1 wt. % titanium, wherein the balance of material to add up to 100 wt. % is iron. Alloys of this type are available under the trade designation "ALNICO".

Any ratio of magnetizable to non-magnetizable particles may be used. In some embodiments, the weight percentage of the magnetizable particles to the total weight of abrasive particles may be at least 35 percent, at least 40 percent, at least 45 percent, at least 50 percent, at least 55 percent, at least 60 percent, at least 65 percent, at least 70 percent, at least 75 percent, at least 80 percent, at least 85 percent, at least 90 percent, or even at least 95 percent. In some embodiments, the weight percentage of the non-magnetizable particles to the total weight of magnetizable particles may be at least 35 percent, at least 40 percent, at least 45 percent, at least 50 percent, at least 55 percent, at least 60 percent, at least 65 percent, at least 70 percent, at least 75 percent, at least 80 percent, at least 85 percent, at least 90 percent, or even at least 95 percent.

The magnetizable particles may have a monomodal or polymodal (e.g., bimodal, trimodal) distribution.

The magnetizable particles and the non-magnetizable particles may comprise the same or different base material compositions. In some preferred embodiments, the magnetizable particles have a magnetizable layer disposed on at least a portion of an abrasive particle.

The abrasive particles, whether crushed or shaped, should have sufficient hardness and surface roughness to function as abrasive particles in an abrading process. Preferably, the abrasive particles (e.g., exclusive of any magnetizable layer that may be present thereon) have a Mohs hardness of at least 4, at least 5, at least 6, at least 7, or even at least 8.

Useful abrasive materials that can be used as abrasive particles include, for example, fused aluminum oxide, heat treated aluminum oxide, white fused aluminum oxide, ceramic aluminum oxide materials such as those commercially available as 3M CERAMIC ABRASIVE GRAIN from 3M Company of St. Paul, Minnesota, black silicon carbide, green silicon carbide, titanium diboride, boron carbide, tungsten carbide, titanium carbide, cubic boron nitride, garnet, fused alumina zirconia, sol-gel derived ceramics (e.g., alumina ceramics doped with chromia, ceria, zirconia, titania, silica, and/or tin oxide), silica (e.g., quartz, glass beads, glass bubbles and glass fibers), feldspar, or flint. Examples of sol-gel derived crushed ceramic particles can be found in U.S. Pat. No. 4,314,827 (Leitheiser et al.), U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.).

As discussed previously, the magnetizable particles may be shaped (e.g., precisely-shaped) or random (e.g., crushed). Shaped abrasive particles and precisely-shaped abrasive particles can be prepared, for example, by a molding process using sol-gel technology as described in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina particles that have been formed in a specific shape, then crushed to form shards that retain a portion of their original shape features. Applying a magnetizable coating to the surface of a shaped non-magnetizable abrasive particle may result in a shaped magnetizable abrasive particle.

Exemplary shapes of abrasive particles include crushed, pyramids (e.g., 3-, 4-, 5-, or 6-sided pyramids), truncated pyramids (e.g., 3-, 4-, 5-, or 6-sided truncated pyramids), cones, truncated cones, rods (e.g., cylindrical, vermiform), and prisms (e.g., 3-, 4-, 5-, or 6-sided prisms).

In those embodiments wherein the abrasive particles and/or magnetizable particles are shaped as triangular platelets, they may have a major surface with a vertex of 90 degrees (corresponding to a right triangle), or they may have a major surface with a vertex of greater than 90 degrees (corresponding to an obtuse triangle), although this is not a requirement. Examples include at least 91 degrees, at least 95 degrees, at least 100 degrees, at least 110 degrees, at least 120 degrees, or even at least 130 degrees.

Crushed abrasive particles (including platey crushed abrasive particles) can be obtained from commercial sources, by known methods, and/or by shape sorting crushed abrasive particles; for example, using a shape-sorting table as is known in the art.

Examples of suitable abrasive particles include crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minnesota, brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof. Further examples include crushed abrasive composites of abrasive particles (which may be platey or not) in a binder matrix, such as those described in U.S. Pat. No. 5,152,917 (Pieper et al.). Many such abrasive particles, agglomerates, and composites are known in the art.

Examples of sol-gel-derived abrasive particles from which crushed abrasive particles can be isolated, and methods for their preparation can be found, in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the crushed abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the crushed abrasive particles may be surface-treated with a coupling agent (e.g., an organosilane coupling agent) or other physical treatment (e.g., iron oxide or titanium oxide) to enhance adhesion of the crushed abrasive particles to a binder. The crushed abrasive particles may be treated before combining them with the binder, or they may be surface treated in situ by including a coupling agent to the binder.

Preferably, the crushed abrasive particles comprise ceramic crushed abrasive particles such as, for example, sol-gel-derived polycrystalline alpha alumina particles. Ceramic crushed abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

Examples of shaped abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina crushed abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them. Details concerning such crushed abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Surface coatings on the various abrasive particles may be used to improve the adhesion between the abrasive particles and a binder in abrasive articles, or can be used to aid in electrostatic deposition. In one embodiment, surface coatings as described in U.S. Pat. No. 5,352,254 (Celikkaya) in an amount of 0.1 to 2 percent surface coating to abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the shaped abrasive particle from capping. Capping is the term to describe the phenomenon where metal particles from the workpiece being abraded become welded to the tops of the crushed abrasive particles. Surface coatings to perform the above functions are known to those of skill in the art.

Crushed abrasive particles used in practice of the present disclosure (e.g., the initial crushed abrasive particles and the optional crushed filler particles) are preferably selected to have a length and/or width in a range of from 0.1 micron to 3500 microns, magnetizable particles have an average maximum particle dimension of 25 to 3000 microns, more typically 100 microns to 3000 microns, and more typically 100 microns to 2600 microns, although other lengths and widths may also be used.

Crushed abrasive particles may be selected to have a thickness in a range of from 0.1 micron to 1600 microns, more typically from 1 micron to 1200 microns, although other thicknesses may be used. In some embodiments, platey crushed abrasive particles may have an aspect ratio (length to thickness) of at least 2, 3, 4, 5, 6, or more.

Length, width, and thickness of the abrasive particles can be determined on an individual or average basis, as desired. Suitable techniques may include inspection and measurement of individual particles, as well as using automated image analysis techniques (e.g., using a dynamic image analyzer such as a CAMSIZER XT image analyzer from Retsch Technology Gmbh of Haan, Germany) according to test method ISO 13322-2:2006 "Particle size analysis—Image analysis methods—Part 2: Dynamic image analysis methods".

Magnetizable abrasive particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). ANSI grade designations (i.e., specified nominal grades) include, for example: ANSI 4, ANSI 6, ANSI 8, ANSI 16, ANSI 24, ANSI 36, ANSI 46, ANSI 54, ANSI 60, ANSI 70, ANSI 80, ANSI 90, ANSI 100, ANSI 120, ANSI 150, ANSI 180, ANSI 220, ANSI 240, ANSI 280, ANSI 320, ANSI 360, ANSI 400, and ANSI 600. FEPA grade designations include F4, F5, F6, F7, F8, F10, F12, F14, F16, F20, F22, F24, F30, F36, F40, F46, F54, F60, F70, F80, F90, F100, F120, F150, F180, F220, F230, F240, F280, F320, F360, F400, F500, F600, F800, F1000, F1200, F1500, and F2000. JIS grade designations include JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS600, JIS800, JIS1000, JIS1500, JIS2500, JIS4000, JIS6000, JIS8000, and JIS10,000

Coated abrasive articles according to the present invention may be converted, for example, into belts, rolls, discs (including perforated discs), and/or sheets. For belt applications, two free ends of the abrasive sheet may be joined together using known methods to form a spliced belt.

In addition to the description contained hereinabove, further description of techniques and materials for making coated abrasive articles may be found in, for example, U.S. Pat. No. 4,314,827 (Leitheiser et al.); U.S. Pat. No. 4,518,397 (Leitheiser et al.); U.S. Pat. No. 4,623,364 (Cottringer et al.); U.S. Pat. No. 4,652,275 (Bloecher et al.); U.S. Pat. No. 4,734,104 (Broberg); U.S. Pat. No. 4,737,163 (Larkey); U.S. Pat. No. 4,744,802 (Schwabel); U.S. Pat. No. 4,770,671 (Monroe et al.); U.S. Pat. No. 4,799,939 (Bloecher et al.); U.S. Pat. No. 4,881,951 (Wood et al.); U.S. Pat. No. 4,927,431 (Buchanan et al.); U.S. Pat. No. 5,498,269 (Larmie); U.S. Pat. No. 5,011,508 (Wald et al.); U.S. Pat. No. 5,078,753 (Broberg et al.); U.S. Pat. No. 5,090,968 (Pellow); U.S. Pat. No. 5,108,463 (Buchanan et al.); U.S. Pat. No. 5,137,542 (Buchanan et al.); U.S. Pat. No. 5,139,978 (Wood); U.S. Pat. No. 5,152,917 (Pieper et al.); U.S. Pat. No. 5,203,884 (Buchanan et al.); U.S. Pat. No. 5,227,104 (Bauer); and U.S. Pat. No. 5,328,716 (Buchanan).

Coated abrasive articles made according to the methods of present disclosure are useful, for example, for abrading a workpiece. Examples of workpiece materials include metal, metal alloys, exotic metal alloys, ceramics, glass, wood, wood-like materials, composites, painted surfaces, plastics, reinforced plastics, stone, and/or combinations thereof. The workpiece may be flat or have a shape or contour associated with it. Exemplary workpieces include metal components, plastic components, particleboard, camshafts, crankshafts, furniture, and turbine blades. The applied force during abrading typically ranges from about 1 kilogram to about 100 kilograms.

Coated abrasive articles made according to the methods of present disclosure may be used by hand and/or used in combination with a machine. At least one of the coated abrasive article and the workpiece is moved relative to the other when abrading. Abrading may be conducted under wet or dry conditions. Exemplary liquids for wet abrading include water, water containing conventional rust inhibiting compounds, lubricant, oil, soap, and cutting fluid. The liquid may also contain defoamers, degreasers, for example.

SELECT EMBODIMENTS OF THE PRESENT DISCLOSURE

In a first embodiment, the present disclosure provides a method of applying magnetizable particles onto an adherent web, the method comprising:

a) providing a magnetizable particle coating apparatus comprising a downward sloping dispensing surface at least partially disposed within an applied magnetic field;

b) disposing the adherent web between upper and lower magnetic members and beneath the downward sloping dispensing surface, wherein the web comprises a backing having a curable binder precursor layer disposed on a major surface thereof; and c) disposing magnetizable particles onto at least a portion of the downward sloping dispensing surface within the applied magnetic field, and subsequently disposing the magnetizable particles onto the curable binder precursor layer while the adherent web is advanced from an upweb position to a downweb position; and d) at least partially curing the curable binder precursor layer to fix the orientations of the magnetizable particles.

In a second embodiment, the present disclosure provides a method according to the first embodiment, wherein the applied magnetic field is provided by:

a lower magnetic member having lower first and second opposite poles; and an upper magnetic member having upper first and second opposite poles, wherein the upper and lower first poles have the same polarity, wherein the upper magnetic member is vertically spaced apart from the lower magnetic member, wherein the upper second pole is disposed closer to the lower first pole than the lower second pole, and wherein the downward sloping dispensing surface disposed between the upper and lower magnetic members.

In a third embodiment, the present disclosure provides a method according to the first or second embodiment, wherein at least one of the upper and lower magnetic members comprises a plurality of contiguous co-aligned magnets.

In a fourth embodiment, the present disclosure provides a method according to any one of the first to third embodiments, wherein at least one of the upper and lower magnetic members includes not permanent magnet comprising at least one of iron, cobalt, nickel In a fifth embodiment, the present disclosure provides a method according to any one of the first to fourth embodiments, wherein the magnetizable particles have an average maximum particle dimension of less than or equal to of 25 to 3000 microns.

In a sixth embodiment, the present disclosure provides a method according to any one of the first to fifth embodiments, wherein the magnetizable particles have an average aspect ratio of at least 3:1.

In a seventh embodiment, the present disclosure provides a method according to any one of the first to sixth embodiments, wherein the magnetizable particles have a magnetizable layer disposed on at least a portion of a non-magnetizable particle.

In an eighth embodiment, the present disclosure provides a method according to any one of the first to seventh embodiments, wherein the applied magnetic field is constant.

In a ninth embodiment, the present disclosure provides a method according to any one of the first to eighth embodiments, wherein, at the location where the magnetizable particles are disposed onto the curable binder precursor layer, the applied magnetic field has magnetic field lines that are oriented at an angle of from 80 to 100 degrees with respect to the major surface of the adherent web.

In a tenth embodiment, the present disclosure provides a method according to any one of the first to eighth embodiments, wherein, at the location where the magnetizable particles are disposed onto the curable binder precursor layer, the applied magnetic field has magnetic field lines that are oriented at an angle of from 10 to 80 degrees or from 100 to 170 degrees with respect to the major surface of the adherent web.

In an eleventh embodiment, the present disclosure provides a method according to any one of the first to tenth embodiments, wherein, at the location where the magnetizable particles are disposed onto the curable binder precursor layer, the web travels along an upwardly sloping path.

In a twelfth embodiment, the present disclosure provides a method according to any one of the first to eleventh embodiments, wherein the curable binder precursor layer comprises a make layer precursor, the magnetizable particles comprise magnetizable abrasive particles, and the at least partially cured curable binder precursor layer comprises a make layer.

In a thirteenth embodiment, the present disclosure provides a method according to the twelfth embodiment, further comprising after step d):

e) disposing a size layer precursor over at least a portion of the magnetizable abrasive particles and the make layer; and f) at least partially curing the size layer precursor to provide a size layer.

In a twelfth embodiment, the present disclosure provides a method according to the eleventh embodiment, further comprising:

g) disposing a supersize layer over at least a portion of the size layer.

In a fourteenth embodiment, the present disclosure provides a method according to the thirteenth embodiment, further comprising:

g) disposing a supersize layer over at least a portion of the size layer.

In a fifteenth embodiment, the present disclosure provides a method according to any one of the twelfth to fourteenth embodiments, wherein the magnetizable abrasive particles comprise magnetizable shaped abrasive particles.

In a sixteenth embodiment, the present disclosure provides a method according to any one of the tenth to fifteenth embodiments, wherein the magnetizable abrasive particles comprise truncated triangular pyramids.

In a seventeenth embodiment, the present disclosure provides a method according to the sixteenth embodiment, wherein at least some of the magnetizable abrasive particles comprise triangular platelets have a major surface having a vertex with an angle of at least 90 degrees.

In an eighteenth embodiment, the present disclosure provides a method according to the sixteenth or seventeenth embodiment, wherein at least some of the magnetizable abrasive particles have a major surface that is a scalene triangle.

In a nineteenth embodiment, the present disclosure provides a method according to any one of the first to eighteenth embodiments, wherein secondary particles are deposited after the magnetizable abrasive particles, but before curing of the curable binder precursor layer.

In a twentieth embodiment, the present disclosure provides a method according to any one of the first to nineteenth embodiments, wherein the web leaves the influence of the applied magnetic field with perpendicular magnetic force lines from the upper magnetic member and the lower magnetic member with respect to the web.

In a twenty-first embodiment, the present disclosure provides a method according to any one of the first to twentieth embodiments, wherein the lower magnetic member extends further downweb than the upper magnetic member.

In a twenty-second embodiment, the present disclosure provides a method according to any one of the first to twenty-first embodiments, wherein the lower magnetic member is disposed upweb from the upper magnetic member.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight. Unless stated otherwise, all other reagents were obtained, or are available from chemical vendors such as Sigma-Aldrich Company, St. Louis, Missouri, or may be synthesized by known methods.

Abbreviations for abrasive particles used in the examples are listed in TABLE 1, below.

TABLE 1

| ABBREVIATION | DESCRIPTION |
|---|---|
| AP1 | Shaped abrasive particles prepared according to the disclosure of U.S. Pat. No. 8,142,531 (Adefris et al). The shaped abrasive particles were prepared by molding alumina sol-gel in a right triangle-shaped polypropylene mold cavities of leg side length 2.53 mm, hypotenuse length 3.58 mm, draft angle of 98 degrees, and a mold depth of 0.71 mm. After drying and firing, the resulting shaped abrasive particles were about 2.0 mm (hypotenuse length) × 1.4 mm (leg side length) × 0.35 mm thick, with a draft angle approximately 98 degrees. |
| AP2 | Shaped abrasive particles were prepared according to the disclosure of U.S. Pat. No. 8,142,531 (Adefris et al). The shaped abrasive particles were prepared by molding alumina sol-gel in equilateral triangle-shaped polypropylene mold cavities. After drying and firing, the resulting equilateral triangular shaped abrasive particles were about 1.4 mm (side length) × 0.35 mm (thickness), with a draft angle approximately 98 degrees. |
| AP3 | Aluminum oxide conforming the FEPA (Federation of the European Producers of Abrasives) standard for P60, obtained as DURALUM in grit size 60 from Washington Mills, Grafton, Massachusetts. |

Assembly of Magnet Apparatus (MA1)

The following description refers to a configuration generally as shown in FIG. 1. Upper magnet assembly UM1 was formed from three identical rectangular magnets, each being 4 inches (10.2 centimeters) wide, 3 inches (7.7 cm) deep, and 2 inches (5.1 cm) in thickness, magnetized through their thickness. The magnets were made of grade N52 magnetic material (obtained from SM Magnetics, Pelham, Alabama). These 3 magnets were arranged to form a magnet assembly 12 inches (30.5 cm) wide by 3 inches (7.6 cm) deep by 2 inches (5.1 cm) thick, with the magnetic poles of each magnet oriented in the same direction, with like poles in the same plane. A 1018 mild steel plate (14 inches (35.6 cm) wide, 5 inches (12.7 cm) deep, and 3 inches (7.6 cm) thick) was adhered to the top of UM1 with epoxy resin (obtained as EPDXY ADHESIVE DP460 from 3M Company, St. Paul, Minnesota). The bottom and upweb magnet surfaces were covered with a 0.1875 inch (0.48 cm) thick sheet of 304 stainless steel.

First lower magnet assembly LM1 was formed in the identical manner as UM, with the exception being that the opposite poles were facing away from the steel plate. This resulted in the 1018 steel plate being on the bottom of the magnet and the 0.1875 inch (0.48 cm) thick sheet of 304 stainless steel covering the top surface of the magnet.

Second lower magnet assembly LM2 was formed from 3 identical rectangular magnets, each being 4 inches (10.2 cm) wide, 6 inches (15.2 cm) deep, and 2 inches (5.1 cm) thick, magnetized through the thickness of grade N52 magnetic material (obtained from SM Magnetics). These three magnets were arranged to form a magnet assembly 12 inches (30.5 cm) wide by 6 inches (15.2 cm) deep by 2 inches (5.1 cm) thick, with the magnetic pole of each magnet oriented in the same direction as LM1, with like poles in the same plane. This magnets arrangement was adhered to a plate of 1018 mild steel (14 inches (35.6 cm) wide by 8 inches (20.3) deep by 3 inches thick) with epoxy resin (obtained as EPDXY ADHESIVE DP460 from 3M Company) and covered with a 0.1875-inch thick sheet of 304 stainless steel.

A composite lower magnetic assembly LM3 was formed by combining LM1 and LM2. LM1 and LM2 were arranged to form a magnet assembly 12 inches (30.5 cm) wide by 9 inches (22.9 cm) deep by 2 inches (5.1 cm) thick, with the 12-inch by 2-inch magnet faces in contact, the 1018 mild steel plates in contact, and the magnetic poles of each magnet oriented in the same direction, with like poles in the same plane. LM1 and LM2 were both bolted to a plate of 1018 steel (14 inches (35.6 cm) wide by 11 inches (27.9 cm) deep by 1 inch (2.5 cm) thick) to create LM3.

LM3 was positioned parallel to the upper magnet UM with a gap of 6 inches (15.2 cm) with both trailing edges aligned. UM1 and LM3 had opposite poles facing each other to create magnet apparatus MA1.

Preparation of Magnetizable Abrasive Particles MAP1

AP1 was coated with 304 stainless steel using physical vapor deposition with magnetron sputtering using a 304 stainless steel sputter target, generally as described by Barbee et al. in *Thin Solid Films,* 1979, vol. 63, pp. 143-150, and deposited as the magnetic ferritic body centered cubic form. The apparatus used for the preparation of 304 stainless steel film coated abrasive particles (i.e., magnetizable abrasive particles) was generally as disclosed in U.S. Pat. No. 8,698,394 (McCutcheon et al.). The physical vapor deposition was carried out for 4 hours at 1.0 kilowatt with an argon sputtering gas pressure of 10 millitorr (1.33 pascal) onto 51.94 grams of AP1. The weight percentage of metal coating in the coated AP1 was approximately 0.65 percent, and the coating thickness was about 1 micrometer.

Preparation of Magnetizable Abrasive Particles MAP2

AP2 was coated with 304 stainless steel using physical vapor deposition with magnetron sputtering. 304 Stainless steel sputter target, described by Barbee et al. in *Thin Solid Films,* 1979, vol. 63, pp. 143-150, deposited as the magnetic ferritic body centered cubic form. The apparatus used for the preparation of 304 stainless steel film coated abrasive particles (i.e., magnetizable abrasive particles) was disclosed in U.S. Pat. No. 8,698,394 (McCutcheon et al.). The physical vapor deposition was carried out for 4 hours at 1.0 kilowatt at an argon sputtering gas pressure of 10 millitorr (1.33 pascal) onto 51.94 grams of AP2. The weight percentage of metal coating in the coated AP2 was approximately 0.65 percent, and the coating thickness was about 1 micrometer.

Example 1

Untreated polyester cloth having a basis weight of 300-400 g/m$^2$, obtained as POWERSTRAIT from Milliken & Company, Spartanburg, South Carolina, was pre-sized at the basis weight of 113 g/m$^2$ with a composition consisting of 75 parts epoxy resin (bisphenol A diglycidyl ether, obtained as EPON 828 from Resolution Performance Products, Houston, Texas), 10 parts of trimethylolpropane triacrylate (obtained as SR351 from Cytec Industrial Inc., Woodland Park, New Jersey), 8 parts of dicyandiamide curing agent (obtained as DICYANEX 1400B from Air Products and Chemicals, Allentown, Pennsylvania), 5 parts of novolac resin (obtained as RUTAPHEN 8656 from Momentive Specialty Chemicals Inc., Columbus, Ohio), 1 part of 2,2-dimethoxy-2-phenylacetophenone (obtained as IRGACURE 651 photoinitiator from BASF Corporation, Florham Park, New Jersey), and 0.75 part of 2-propylimidazole (obtained under trade designation ACTIRON NXJ-60 LIQUID from Synthron, Morganton, North Carolina).

The cloth backing was coated with 209 g/m$^2$ of a phenolic make resin consisting of 52 parts of resole phenolic resin (obtained under trade designation GP 8339 R-23155B" from Georgia Pacific Chemicals, Atlanta, Georgia), 45 parts of calcium metasilicate (obtained as WOLLASTOCOAT from NYCO Company, Willsboro, NY), and 2.5 parts of water.

Abrasive particles MAP1 were dispensed to the make resin-coated backing via a sloped dispensing ramp as the backing was passing through magnet apparatus MA1 (generally, as shown in FIG. 1). The end of the sloped dispensing ramp was 0.5 inches from the surface of the backing and 6.25 inches from the bottom trailing corner of the upper magnet. The coating weight of MAP1 was 115 grains per 24 square inches (481.3 g/m$^2$). Immediately after abrasive particles MAP1 were coated onto the backing, abrasive particles AP3 were coated onto the backing with a coating weight of 90 grains per 24 square inches (376.6 g/m$^2$).

The abrasive coated backing was placed in an oven at 90° C. for 1.5 hours to partially cure the make resin. A size resin consisting of 45.76 parts of resole phenolic resin (obtained as GP 8339 R-23155B from Georgia Pacific Chemicals), 4.24 parts of water, 24.13 parts of cryolite (Solvay Fluorides, LLC, Houston, Texas), 24.13 parts calcium metasilicate (obtained as WOLLASTOCOAT from NYCO Company, Willsboro, New York) and 1.75 parts red iron oxide was applied to each strip of backing material at a basis weight of 712 g/m$^2$, and the coated strip was placed in an oven at 90° C. for 1 hour, followed by 8 hours at 102° C. After curing, the strip of coated abrasive was converted into a coated abrasive belt.

Comparative Example A

Untreated polyester cloth having a basis weight of 300-400 g/m$^2$, obtained as POWERSTRAIT from Milliken &

Company, was pre-sized at the basis weight of 113 g/m$^2$ with a composition consisting of 75 parts bisphenol A diglycidyl ether (obtained as EPON 828 from Resolution Performance Products), 10 parts of trimethylolpropane triacrylate (obtained as SR351 from Cytec Industrial Inc.), 8 parts of dicyandiamide curing agent (obtained as DICYANEX 1400B from Air Products and Chemicals), 5 parts of novolac resin (obtained as RUTAPHEN 8656 from Momentive Specialty Chemicals Inc.), 1 part of 2,2-dimethoxy-2-phenylacetophenone (obtained as IRGACURE 651 photoinitiator from BASF Corporation), and 0.75 part of 2-propylimidazole (obtained as ACTIRON NXJ-60 LIQUID from Synthron).

The cloth backing was coated with 209 g/m$^2$ of a phenolic make resin consisting of 52 parts of resole phenolic resin (obtained as GP 8339 R-23155B from Georgia Pacific Chemicals), 45 parts of calcium metasilicate (obtained as WOLLASTOCOAT from NYCO Company, Willsboro, NY), and 2.5 parts of water.

MAP2 were dispensed to the make resin-coated backing as the backing was passing through magnet apparatus MA1 as generally as shown in FIG. 1. The end of the sloped dispensing ramp was 0.5 inch (1.3 cm) from the surface of the backing and 6.25 inches (15.9 cm) from the bottom trailing corner of the upper magnet. The coating weight of MAP1 was 115 grains per 24 square inches (481.3 g/m$^2$). Immediately after abrasive particles MAP1 were coated onto the backing, abrasive particles AP3 were coated onto the backing with a coating weight of 90 grains per 24 square inches (376.6 g/m$^2$).

The abrasive coated backing was placed in an oven at 90° C. for 1.5 hours to partially cure the make resin. A size resin consisting of 45.76 parts of resole phenolic resin (obtained as GP 8339 R-23155B from Georgia Pacific Chemicals), 4.24 parts of water, 24.13 parts of cryolite from Solvay Fluorides, LLC, 24.13 parts calcium metasilicate (obtained as WOLLASTOCOAT from NYCO Company) and 1.75 parts red iron oxide was applied to each strip of backing material at a basis weight of 712 g/m$^2$, and the coated strip was placed in an oven at 90° C. for 1 hour, followed by 8 hours at 102° C. After cure, the strip of coated abrasive was converted into a coated abrasive belt.

Abrading Test Method

A 40.6 cm long×30.48 cm×1.6 cm thick particle board workpiece, obtained as COLLINS PINE PARTICLE BOARD from The Collins Company, Portland, Oregon, was secured to a test fixture in a position to be abraded on its 30.48 cm edge by the abrasive belts, each being endless abrasive belts having dimensions of 5.08 cm×91.44 cm. In each test, the abrasive belt was backed up by a graphite covered platen. In each test, the board was pressed into the abrasive belt as the belt is moving at a feed rate of 5500 surface feet per minute (1676 surface meters per minute). A force of 15 pound-force (66.7 N) was applied to the board and the board was left in contact with the abrasive belt for 10 seconds of grind time. The board was removed from the belt and the amount of material removed from the board was measured. The process was repeated for a total of 25 cycles. The test was executed in a first direction of use in a forward direction and an opposite second direction of use in a reverse direction. The cut in mm of the particle board removed was recorded after each cycle.

Abrading Test results are reported in TABLE 2, below:

TABLE 2

| | CUT, grams | | | |
|---|---|---|---|---|
| CYCLE NUMBER | EXAMPLE 1 | EXAMPLE 1 run in reverse belt direction | COMPARATIVE EXAMPLE A | COMPARATIVE EXAMPLE A run in reverse belt direction |
| 1 | 18.47 | 8.7 | 7.61 | 8.54 |
| 2 | 20.35 | 7.78 | 7.46 | 7.85 |
| 3 | 20.51 | 7.71 | 7.54 | 7.84 |
| 4 | 20.43 | 7.17 | 7.5 | 7.72 |
| 5 | 20.24 | 7.36 | 7.56 | 7.71 |
| 6 | 20.51 | 7.33 | 7.1 | 7.65 |
| 7 | 20.32 | 7.01 | 7.56 | 7.66 |
| 8 | 20.55 | 6.92 | 7.2 | 7.51 |
| 9 | 20.45 | 7.21 | 7.35 | 7.52 |
| 10 | 20.23 | 7.06 | 7.17 | 7.56 |
| 11 | 19.93 | 7.26 | 7.19 | 7.31 |
| 12 | 19.79 | 6.99 | 7.49 | 7.36 |
| 13 | 18.47 | 6.95 | 7.01 | 7.47 |
| 14 | 18.24 | 6.94 | 6.99 | 7.26 |
| 15 | 18.06 | 7.07 | 6.86 | 7.62 |
| 16 | 18.13 | 6.96 | 6.8 | 7.39 |
| 17 | 17.93 | 6.98 | 6.59 | 7.47 |
| 18 | 18.43 | 6.98 | 6.31 | 7.42 |
| 19 | 18.81 | 7.42 | 6.45 | 7.42 |
| 20 | 19.24 | 6.8 | 6.37 | 7.18 |
| 21 | 19.15 | 6.96 | 6.17 | 7.04 |
| 22 | 18.98 | 7.04 | 6.5 | 7.03 |
| 23 | 19.04 | 7 | 5.73 | 6.99 |
| 24 | 19.17 | 7.11 | 5.5 | 6.89 |
| 25 | 19.86 | 7.17 | 5.33 | 6.75 |
| Total Cut | 485.29 | 179.88 | 171.34 | 186.16 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of applying magnetizable particles onto an adherent web, the method comprising:

a) providing a magnetizable particle coating apparatus comprising a downward sloping dispensing surface at least partially disposed within an applied magnetic field;

b) disposing the adherent web between upper and lower magnetic members and beneath the downward sloping dispensing surface, wherein the upper magnetic member is vertically spaced apart from the lower magnetic member, wherein the downward sloping dispensing surface is vertically disposed between the upper and lower magnetic members, wherein the downward sloping dispensing surface is constructed of a dimensionally stable non-magnetizable material, and wherein the web comprises a backing having a curable binder precursor layer disposed on a major surface thereof;

c) disposing magnetizable particles onto at least a portion of the downward sloping dispensing surface within the applied magnetic field, and subsequently disposing the magnetizable particles onto the curable binder precursor layer while the adherent web is advanced from an upweb position to a downweb position; and d) at least partially curing the curable binder precursor layer to fix the orientations of the magnetizable particles.

2. The method of claim 1, wherein the applied magnetic field is provided by:

the lower magnetic member having lower first and second opposite poles; and the upper magnetic member having upper first and second opposite poles, wherein the upper and lower first poles have the same polarity, and wherein the upper second pole is disposed closer to the lower first pole than the lower second pole.

3. The method of claim 1, wherein at least one of the upper and lower magnetic members comprises a plurality of contiguous co-aligned magnets.

4. The method of claim 1, wherein the magnetizable particles have an average maximum particle dimension of 25 to 3000 microns.

5. The method of claim 1, wherein the magnetizable particles have an average aspect ratio of at least 3:1.

6. The method of claim 1, wherein the magnetizable particles have a magnetizable layer disposed on at least a portion of a non-magnetizable particle.

7. The method of claim 1, wherein the applied magnetic field is constant.

8. The method of claim 1, wherein, at the location where the magnetizable particles are disposed onto the curable binder precursor layer, the applied magnetic field has magnetic field lines that are oriented at an angle of from 80 to 100 degrees with respect to the major surface of the adherent web.

9. The method of claim 1, wherein the curable binder precursor layer comprises a make layer precursor, the magnetizable particles comprise magnetizable abrasive particles, and the at least partially cured curable binder precursor layer comprises a make layer.

10. The method of claim 9, further comprising after step d):

e) disposing a size layer precursor over at least a portion of the magnetizable abrasive particles and the make layer; and f) at least partially curing the size layer precursor to provide a size layer.

11. The method of claim 10, further comprising:

g disposing a supersize layer over at least a portion of the size layer.

12. The method of claim 1, wherein the magnetizable abrasive particles comprise magnetizable shaped abrasive particles.

13. The method of claim 1, wherein the magnetizable abrasive particles comprise truncated triangular pyramids.

14. The method of claim 1, wherein at least some of the magnetizable abrasive particles comprise triangular platelets have a major surface having a vertex with an angle of at least 90 degrees.

15. The method of claim 14, wherein at least some of the magnetizable abrasive particles have a major surface that is a scalene triangle.

16. The method of claim 1, wherein secondary particles are deposited after the magnetizable abrasive particles, but before curing of the curable binder precursor layer.

17. The method of claim 1, wherein the web leaves the influence of the applied magnetic field with perpendicular magnetic force lines from the upper magnetic member and the lower magnetic member with respect to the web.

18. The method of claim 1, wherein the lower magnetic member extends further downweb than the upper magnetic member.

19. A method of applying magnetizable particles onto an adherent web, the method comprising:

a) providing a magnetizable particle coating apparatus comprising a downward sloping dispensing surface at least partially disposed within an applied magnetic field;

b) disposing the adherent web between upper and lower magnetic members and beneath the downward sloping dispensing surface, wherein the downward sloping dispensing surface is constructed of a dimensionally stable non-magnetizable material, and wherein the web comprises a backing having a curable binder precursor layer disposed on a major surface thereof;

c) disposing magnetizable particles onto at least a portion of the downward sloping dispensing surface within the applied magnetic field, and subsequently disposing the magnetizable particles onto the curable binder precursor layer while the adherent web is advanced from an upweb position to a downweb position, wherein, at the location where the magnetizable particles are disposed onto the curable binder precursor layer, the applied magnetic field has magnetic field lines that are oriented at an angle of from 10 to 80 degrees or from 100 to 170 degrees with respect to the major surface of the adherent web; and d) at least partially curing the curable binder precursor layer to fix the orientations of the magnetizable particles.

20. A method of applying magnetizable particles onto an adherent web, the method comprising:

a) providing a magnetizable particle coating apparatus comprising a downward sloping dispensing surface at least partially disposed within an applied magnetic field;

b) disposing the adherent web between upper and lower magnetic members and beneath the downward sloping dispensing surface, wherein the downward sloping dispensing surface is constructed of a dimensionally stable non-magnetizable material, and wherein the web comprises a backing having a curable binder precursor layer disposed on a major surface thereof;

c) disposing magnetizable particles onto at least a portion of the downward sloping dispensing surface within the applied magnetic field, and subsequently disposing the magnetizable particles onto the curable binder precursor layer while the adherent web is advanced from an upweb position to a downweb position, wherein, at the location where the magnetizable particles are disposed onto the curable binder precursor layer, the web travels along an upwardly sloping path; and d) at least partially curing the curable binder precursor layer to fix the orientations of the magnetizable particles.

* * * * *